United States Patent [19]

Boelens et al.

[11] 4,040,986

[45] Aug. 9, 1977

[54] PREPARATION OF 4-METHOXYBENZONITRILE PERFUME COMPOSITIONS

[75] Inventors: Harmannus Boelens; Hendrik J. Takken, both of Huizen; Petrus C. Traas, Naarden, all of Netherlands

[73] Assignee: Naarden International N.V., Naarden-Bussum, Netherlands

[21] Appl. No.: 654,936

[22] Filed: Feb. 3, 1976

[30] Foreign Application Priority Data

Feb. 11, 1975 Netherlands ..... 7501607

[51] Int. Cl.[2] ..... C11B 9/00

[52] U.S. Cl. ..... 252/522; 260/465 F; 424/69; 252/89 R; 252/174

[58] Field of Search ..... 252/522; 260/465 F

[56] References Cited

U.S. PATENT DOCUMENTS

| | | | |
|---|---|---|---|
| 3,714,220 | 1/1973 | Dahill | 252/522 |
| 3,870,742 | 3/1975 | Klein | 252/522 |
| 3,910,853 | 10/1975 | Kulka | 252/522 |
| 3,920,585 | 11/1975 | Klein | 252/522 |
| 3,928,247 | 12/1975 | Mookherjee et al. | 252/522 |
| 3,960,923 | 6/1976 | De Simone | 252/522 |
| 3,974,201 | 8/1976 | Boeleus | 252/522 |
| Re. 27,332 | 4/1972 | Somerville et al. | 252/522 |

*Primary Examiner*—Veronica O'Keefe

*Attorney, Agent, or Firm*—Stevens, Davis, Miller & Mosher

[57] ABSTRACT

A process for the production of perfume compositions, perfumed materials or perfumed articles which includes admixing perfume components usual for this purpose and 4-methoxy benzonitrile and the compositions per se.

2 Claims, No Drawings

PREPARATION OF 4-METHOXYBENZONITRILE PERFUME COMPOSITIONS

The invention relates to a process for the preparation of perfume compositions. More specifically the invention relates to the use of 4-methoxybenzonitrile in preparing perfume compositions or perfumed products.

The odor character of coumarin is highly esteemed in perfumery and therefore economically important. However the application of coumarin as a component of perfume compositions suffers from two major disadvantages. In the first place coumarin is not stable in an alkaline medium (such as toilet soap etc.), causing odor changes and discoloration, when products perfumed with coumarin are kept for some time. Secondly, doubts have been raised regarding the physiological innocuity of coumarin. Thus there is a need for odorant substances with an odor resembling that of coumarin which do not cause discolorations in perfume products and have a stable odor on storage.

Several aliphatic and alicyclic nitriles have been described as suitable for application as odorants. In many cases the odor character is similar to that of the corresponding aldehydes. See for instance: Dutch Pat. No. 130,627 (British Pat. No. 997,935; U.S. Pat. No. 3,168,550), Dutch Patent Application No. 69 18946 and 69 18947 (see also British Pat. No. 1,018,836 or U.S. Pat. No. 3,325,369), British Pat. No. 1,182,386, Dutch Patent Application No. 73 09127 (British Pat. No. 1,402,950) and Dutch Patent Application No. 73 15608.

It also is known that the odor of the monosubstituted benzene derivative benzonitrile clearly resembles that of the corresponding aldehyde: benzaldehyde. See e.g. J. V. Dubsky, Deutsche Parf. Ztg. 2 (1916), 197 and 348; M. G. J. Beets, Am. Perf. and Cosm. 76 (961), June, 54–63; R. H. Wright, The Science of Smell, George Allen & Unwin Ltd. London (1964) 128–129.

Applicant has established that on the substitution of a hydrogen atom of the benzene nucleus by an alkyl group this odor analogy between benzonitrile derivative and the corresponding aldehyde is retained. For instance 4-isopropylbenzonitrile and 4-isopropylbenzaldehyde have almost identical odors.

It also has been reported in the literature (Dubsky, Beets, vide supra) that on substitution of hydrogen atoms in benzonitrile by strongly polar groups the odor analogy with the corresponding aldehyde would still be retained. Accordingly the odor of 3-methoxy-4-hydroxybenzonitrile (Vanillic acid nitrile) is reported to resemble strongly the odor of 3-methoxy-4-hydroxybenzaldehyde. A comparable resemblance is reported to exist between 3,4-dioxymethylenebenzonitrile and 3,4-dioxymethylenebenzaldehyde (Heliotropin).

Applicant has prepared 3-methoxy-4-hydroxybenzonitrile and 3,4-dioxymethylenebenzonitrile and has carefully purified them by repeated crystallization. It was found that both compounds are virtually odorless and therefore, olfactively, very different from the corresponding aldehydes, since these aldehydes are powerful and longlasting fragrance compounds. In Applicant's opinion the reported similarity between these nitriles and the corresponding aldehydes must be attributed to small amounts of aldehydes present as impurity in the nitriles. This is supported by the fact that these nitriles are preferably prepared from the corresponding aldehydes via the oximes. On these grounds one would expect 4-methoxybenzonitrile either to have the same odor properties as the corresponding 4-methoxybenzaldehyde (anisaldehyde) or to be virtually odorless and therefore unsuitable for use as a fragrance compound.

However, it was surprisingly found that 4-methoxybenzonitrile has a very strong odor, with only a slight resemblance to anisaldehyde, but strongly reminiscent of coumarin. Moreover 4-methoxybenzonitrile is much more stable than coumarin, especially in alkaline media. It does not show any odor deviation or decrease, nor does it cause any discoloration, even after prolonged storage of products perfumed according to the present invention.

The application of fragrance compounds in certain products, such as cosmetic powders and powdered detergents, requires a high standard of stability for these compounds, since oxidation is stimulated by the vast surface area of these powders. Due to its high stability 4-methoxybenzonitrile is very well suited for perfuming such products. It may be used as such or it may be combined with other single compounds or mixtures (e.g. essential oils) to obtain a perfume composition.

The term perfume composition is used here to mean a mixture of fragrance (and auxiliary) compounds, dissolved in a suitable solvent or mixed with a suitable powdered substrate as desired, used to impart a desired odor to various kinds of products. Examples of such products are soaps, detergents, cleaners, cosmetic products, room deodorants, etc.

The amount of 4-methoxybenzonitrile to be used in perfume compositions according to the present invention depends on many variables, such as other components, their amounts and the odor effect one wants to achieve.

It was found that as little as 0.01% by weight or even less may be a useful amount in perfume compositions. However, in certain cases amounts of 10% or even more may be used. The amount of 4-methoxybenzonitrile in perfumed products depends on the amount of perfume composition used in preparing these products. Therefore in some cases an amount of only 0.0001% by weight of 4-methoxybenzonitrile may be sufficient to impart a coumarin-like odor not to soaps, cosmetics and other products.

On the other hand an amount of 3–4% by weight of 4-methoxybenzonitrile may be necessary to impart a discernible coumarin-like note to strongly perfumed products and ready perfumes.

The following examples illustrate the application of 4-methoxybenzonitrile and its advantages over coumarin.

EXAMPLE 1

Perfume composition of the Fougere type.

Two perfume compositions were prepared according to the following recipe, coumarin and 4-methoxybenzonitrile being used as Component X respectively.

| | |
|---|---|
| 100 | parts by weight Component X. |
| 25 | parts by weight Musk Ambrette |
| 25 | parts by weight Oakmoss absolute Jugoslavian |
| 100 | parts by weight Amylsalicylate |
| 25 | parts by weight Eugenol |
| 50 | parts by weight Patchuli oil |
| 50 | parts by weight Geranium oil Bourbon |
| 25 | parts by weight Vetiverylacetate |
| 25 | parts by weight Ylang ylang I |
| 100 | parts by weight Lemon oil Italian |
| 40 | parts by weight Rosana NB 131*) |
| 30 | parts by weight Citronellol |
| 20 | parts by weight Nerol |
| 45 | parts by weight Phenylethanol |

-continued

| | |
|---|---|
| 10 | parts by weight Clary sage oil |
| 30 | parts by weight Oil of Rosemary French |
| 100 | parts by weight Lavandin Oil French |
| 200 | parts by weight Lavender Oil Bareme |
| 1000 | |

*)Perfume base of Naarden International.

Both compositions were equally highly appreciated and were very similar in top note, body and fond.

EXAMPLE 2

Test of 4-methoxybenzonitrile in toilet soap

Two kinds of perfumed toilet soap were prepared, starting with a white soap. One kind was perfumed with 1% by weight of coumarin and the other with 1% by weight of 4-methoxybenzonitrile. Sample bars of both kinds were kept in an oven at 50° C. for two weeks and subsequently compared with similar samples kept at room temperature. The samples perfumed with coumarin had a pale brown color and had lost much of their original odor. The samples perfumed with 4-methoxybenzonitrile were still white and virtually retained their original odor.

EXAMPLE 3

Test of 4-methoxybenzonitrile in a liquid detergent

Two kinds of liquid detergent concentrate were prepared. One was perfumed with 0.1% by weight of coumarin and the other with 0.1% by weight of 4-methoxybenzonitrile. Samples of both kinds were kept for two weeks at room temperature. The originally colorless detergent concentrate perfumed with coumarin now had a yellow color whereas the detergent concentrate perfumed with 4-methoxybenzonitrile remained colorless.

0.1 g portions of all samples were dissolved in 100 ml of hot water each. These solutions were compared with corresponding solutions made of freshly prepared samples. The two week old samples perfumed with coumarin lost much of their original odor and showed an off door. The samples perfumed with 4-methoxybenzonitrile had retained their original odor.

EXAMPLE 4

Test of 4-methoxybenzonitrile in detergent powder

Samples of detergent powders were perfumed with 0.2% by weight of coumarin or 0.2% by weight of 4-methoxybenzonitrile and kept at 30° C. for two weeks. The samples perfumed with coumarin discolored to yellow or pale brown and substantially lost their original odor whereas the samples perfumed with 4-methoxybenzonitrile were still white and retained their original odor.

EXAMPLE 5

Test of 4-methoxybenzonitrile in a Cosmetic Powder

The test of Example 4 was repeated using talcum powder instead of detergent powder. Again, as opposed to coumarin, 4-methoxybenzonitrile showed to be stable with respect to color and odor.

What is claimed is:

1. A process for the production of perfume compositions, comprising admixing perfume components usual for this purpose and 4-methoxybenzonitrile in an amount of 0.0001–10% by weight.

2. Perfume composition comprising perfume components usual for this purpose and 4-methoxybenzonitrile in an amount of 0.0001–10% by weight.

* * * * *